US007414227B2

(12) United States Patent
Kanzaki et al.

(10) Patent No.: US 7,414,227 B2
(45) Date of Patent: Aug. 19, 2008

(54) HIGH FREQUENCY HEATING DEVICE WITH STEAM GENERATING FUNCTION

(75) Inventors: Kouji Kanzaki, Yamatokoriyama (JP); Yuji Hayakawa, Shiki-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 191 days.

(21) Appl. No.: 10/547,897

(22) PCT Filed: Mar. 10, 2004

(86) PCT No.: PCT/JP2004/003108

§ 371 (c)(1),
(2), (4) Date: Sep. 8, 2005

(87) PCT Pub. No.: WO2004/081454

PCT Pub. Date: Sep. 23, 2004

(65) Prior Publication Data

US 2006/0191915 A1 Aug. 31, 2006

(30) Foreign Application Priority Data

Mar. 12, 2003 (JP) ..... 2003-067065

(51) Int. Cl.
*H05B 6/10* (2006.01)
*H05B 6/64* (2006.01)

(52) U.S. Cl. ..... 219/628; 219/682

(58) Field of Classification Search ..... 219/628, 219/682, 687, 772, 629, 630, 631; 137/341; 138/33; 336/55, 56; 392/311
See application file for complete search history.

(56) References Cited

U.S. PATENT DOCUMENTS

| | | | | |
|---|---|---|---|---|
| 4,417,116 | A * | 11/1983 | Black | 219/688 |
| 4,454,404 | A * | 6/1984 | Zushi | 219/682 |
| 5,237,144 | A * | 8/1993 | Iguchi | 219/628 |
| 5,786,577 | A * | 7/1998 | Han et al. | 219/682 |
| 6,008,482 | A * | 12/1999 | Takahashi et al. | 219/687 |
| 6,040,564 | A * | 3/2000 | Ueda et al. | 219/682 |
| 6,133,558 | A * | 10/2000 | Ueda et al. | 219/682 |
| 6,956,190 | B2 * | 10/2005 | Sano et al. | 219/682 |
| 7,199,340 | B2 * | 4/2007 | Yamasaki et al. | 219/682 |

FOREIGN PATENT DOCUMENTS

| | | |
|---|---|---|
| JP | 54-10460 | 1/1979 |
| JP | 54-55684 | 4/1979 |
| JP | 54-115448 | 9/1979 |
| JP | 8-105628 | 4/1996 |
| JP | 8-178298 | 7/1996 |
| JP | 11-151166 | 6/1999 |
| JP | 2001-355844 | 12/2001 |

OTHER PUBLICATIONS

Microfilm of the specification and drawings annexed to the request of Japanese Utility Model Application No. 128809/1977 (Laid-open No. 55684-1979), Matsushita Electric Industrial Co., Ltd., Apr. 17, 1979.

Microfilm of the specification and drawings annexed to the request of Japanese Utility Model Application No. 200156/1985 (Laid-open No. 108702/1987), Matsushita Electric Industrial Co., Ltd., Jul. 11, 1987.

* cited by examiner

*Primary Examiner*—Daniel L Robinson
(74) *Attorney, Agent, or Firm*—Pearne & Gordon LLP

(57) ABSTRACT

The object of the present invention is to achieve a high frequency heating apparatus having a steam generating function that can implement simplification and miniaturization of the construction of a steam supply mechanism by omitting dedicated pump means for supplying water of a water tank.

In a high frequency heating apparatus having a steam generating function (100), a steam supply mechanism (7) for supplying heating steam into a heating chamber (3) is constructed by a water tank (21) detachably equipped to the main body of the apparatus, water supply trays 825), (25) mounted in the heating chamber (3), heating means (27), (27) for vaporizing water on the water supply trays (25), (25) by heating the water supply trays (25), (25), and water supply paths (29), (29) for leading water in the water tank (21) through heating areas based on the heating means (27), (27) to the water supply trays (25), (25), and the water in the water tank (21) is supplied to the water supply trays (25), (25) by using thermal expansion of water in the water supply paths (29), (29) which is caused by the heat generated in the heating means (27), (27).

7 Claims, 10 Drawing Sheets

HIGH FREQUENCY HEATING DEVICE WITH STEAM GENERATING FUNCTION

TECHNICAL FIELD

The present invention relates to a high frequency heating apparatus equipped with high frequency generating means for outputting a high frequency wave into a heating chamber in which a heating target to be heated is accommodated and a steam supply mechanism for supplying steam into the heating chamber, and supplying at least one of the high frequency wave and the steam into the heating chamber to conducting a heating treatment on the heating target, and particularly to an improvement of implementing simplification and miniaturization of the construction of the steam supply mechanism.

BACKGROUND ART

A high frequency heating apparatus having a high frequency wave generating means for outputting a high frequency wave into a heating chamber in which a heating target to be heated is accommodated can efficiently heat the heating target in the heating chamber in a short time, and thus it has become rapidly widespread as a microwave oven which is a cooling instrument for foodstuff.

However, only the heating based on the high frequency heating limits the range of cooling or the like, and thus it has been inconvenient.

Therefore, there has been proposed a high frequency heating apparatus with which oven heating can be performed by adding an electric heater heating in the heating chamber, and further there has been also recently proposed a high frequency heating apparatus having a steam generating function with which cooking with high-temperature steam can be also performed by further adding a steam supply mechanism for supplying heating steam to the heating chamber (for example, see patent document 1).

(Patent Document 1) JP-A-54-115448

The steam supply mechanism of the conventional high frequency heating apparatus is designed to be equipped with a water tank detachably secured to the main body of the apparatus, a water supply tray mounted in the heating chamber, heating means for heating the water supply tray and vaporizing water on the water supply tray, and dedicated pump means for supplying water in the water tank to the water supply tray, and the equipment of the pump means causes a problem that the construction of the apparatus is complicated and large in size.

Furthermore, in the conventional steam supply mechanism using the dedicated pump means, in order to control the supply amount of steam to the heating chamber, it is required to control the supply amount based on the pump means simultaneously with temperature control of the heating means, and thus there is a problem that the control treatment needed for the supply amount control of steam is complicated.

Furthermore, water stocked in the water tank is fed to the water supply tray by the dedicated pump means, and during this feeding operation, the water is fed without being subjected to preliminary heating or the like (in order to avoid occurrence of a pump trouble due to hot water). Therefore, there is also a problem that the temperature of the water supplied to the water supply tray is low and it takes a long time to heat the water supply tray and generate steam by the heating means.

The present invention has been implemented in view of the foregoing problem, and has an object to provide a high frequency heating apparatus having a steam generating function with which there is required no dedicated pump means for supplying water in a water tank to a water supply tray, simplification and miniaturization of the construction of a steam supply mechanism can be implemented by omitting the pump means, control processing needed to control the supply amount of steam can be simplified, and steam-heating can be rapidly performed by shortening a time required to generate steam.

DISCLOSURE OF THE INVENTION

In order to attain the above object, according to claim 1, a high frequency heating apparatus having a steam generating function that is equipped with high frequency wave generating means for outputting a high frequency wave into a heating chamber in which a heating target to be heated is accommodated, and a steam supply mechanism for supplying heating steam into the heating chamber, at least one of the high frequency wave and the heating steam being supplied into the heating chamber to carry out a heating treatment on the heating target, is characterized in that the steam supply mechanism comprises a water tank detachably secured to the main body of the apparatus, a water supply tray mounted in the heating chamber, heating unit for heating the water supply tray to vaporize water on the water supply tray, and a water supply path for leading water in the water tank to the water supply tray through a heating area based on the heating means, whereby water in the water supply path which is thermally expanded through thermal conduction of heat generated by the heating means is supplied to the water supply tray.

In the high frequency heating apparatus having the steam generating function thus constructed, the water supply path is laid so as to pass through the heating area of the heating means, and a pumping function is achieved by the thermal expansion of the water in the water supply path which is caused by the heat generated by the heating means. Therefore, it is not required to provide a dedicated pump means for supplying water in the water tank to the water supply tray.

Accordingly, the construction of the steam supply mechanism can be simplified and miniaturized by omitting the dedicated pump means.

Furthermore, the supply of water to the water supply tray is carried out by the generated heat of the heating means. Therefore, the control of the supply amount of steam can be implemented by only controlling the heating operation of the heating means, and the control processing needed to control the supply amount of steam can be more simplified as compared with a conventional apparatus in which a dedicated pump means must be controlled.

Still furthermore, the water supplied to the water supply tray is kept to be increased in temperature by the generated heat of the heating means, and thus the time required from the supply of water to the water supply tray till the generation of steam can be shortened. Therefore, it is possible to rapidly heat the steam.

In order to attain the above object, a high frequency heating apparatus having a steam generating function of claim 2 is characterized in that in the high frequency heating apparatus having the steam generating function of claim 1, the steam supply mechanism is further equipped with a temperature detecting sensor for detecting the temperature of the heating means or the water supply tray, and utilizes the detection signal of the temperature detecting sensor for detect the residual amount zero of the water tank or control the operation of the heating means (control the steam supply amount).

For example, when the residual amount of the water tank is equal to 0 (zero) and the residual water amount on the water supply tray is reduced, the quantity of heat consumed by steaming water is reduced, and thus the temperature of the heating means or the water supply tray is increased.

Accordingly, the temperature sensor for detecting the temperature of the heating means or the water supply tray is equipped and the detection signal of the temperature sensor is monitored as described above, whereby the residual amount 0 of the water tank can be detected relatively simply.

Furthermore, for example when the residual amount 0 of the water tank is detected, various kinds of control such as stop of the operation of the heating means, alarming for water supply, etc. can be performed, and the handling performance of the high frequency heating apparatus can be enhanced.

In order to attain the above object, a high frequency heating apparatus according to claim 3 is characterized in that in the high frequency heating apparatus having the steam generating function of claim 2, the heating means is formed by disposing a heater in an assembly block of aluminum die cast, and the temperature detecting sensor serves as a thermistor secured to the assembly block so that generation of the steam amount and detection of abnormality when water has been wasted can be performed by a single thermistor.

The thermistor disposed in the assembly block may detect the temperature of the heater equipped to the assembly block as the temperature which is reduced by the temperature of water on the water supply tray brought into contact with the assembly block. Accordingly, if water has been wasted on the water supply tray, the temperature which is substantially coincident with the temperature of the heater is detected by the single thermistor, and if water exists, the temperature increasing state till steam is generated can be detected by the single thermistor.

In order to attain the above object, a high frequency heating apparatus having a steam generating function according to claim 4 may be characterized in that in the high frequency heating apparatus having the steam generating function of claim 2 or 3, the steam supply mechanism is further equipped with a control circuit for judging that the residual amount of the water tank is equal to 0 and stopping steam heating when a cycle of interrupting current supply to the heater when the detection temperature of the thermistor exceeds a predetermined upper limit reference value and re-supplying current to the heater when the detection temperature of the thermistor is reduced to less than a predetermined lower limit reference value with time lapse is carried out at least twice or more.

For example when the detection temperature of the thermistor exceeds the upper limit reference value twice, the steam supply mechanism interrupts current supply to the heater to stop steam heating. Accordingly, it is possible to lengthen the lifetime of the heater and use the water supply tray within a heat-resistance temperature range, and fluorinating material on the water supply tray can be prevented from being deteriorated.

Furthermore, in order to attain the above object, a high frequency heating apparatus having a steam generating function according to claim 5 is characterized in that in the high frequency heating apparatus having the steam generating function of claims 1 to 4, the steam supply mechanism is further equipped with a check valve at the base end side of the water supply path to prevent thermally expanded water from flowing back to the water tank side, and when a plurality of pairs of water supply trays and heating means are equipped, the distance from the heating area based on the heating means to a water blow-out port at the tip of each water supply path equipped every water supply tray is set to be equal among the water supply paths.

From the viewpoint of preventing occurrence of non-uniform heating of heating steam in the heating chamber of the high frequency heating apparatus, it is desirable that steam generators each comprising the water supply tray and the heating means are dispersively equipped at plural places in the heating chamber to uniformly supply heating steam in the heating chamber. However, if the steam generators are dispersively equipped at the plural places, it is needed to uniformly supply water to the water supply trays at the plural places.

Therefore, when plural pairs of water supply trays and heating means are equipped as described above, if the distance from the heating area based on the heating means to a water blow-out port at the tip of each water supply path equipped every water supply tray is set to be equal among the water supply paths, the water supply amounts through the water supply paths can be made coincident with one another without particularly controlling the flow amount of water to be supplied, so that the uniform supply of heated water in the heating chamber can be implemented in low cost.

Furthermore, in order to attain the above object, a high frequency heating apparatus having a steam generating function according to claim 6 is characterized in that in the high frequency heating apparatus having the steam generating function according to claims 1 to 5, the steam supply mechanism is provided with a waterproof valve for preventing water leakage at each of the water tank side of the detachably-equipped water tank and the base end side of the water supply path.

The waterproof valves are respectively provided to the pipes at the water tank side and the water supply path side, and thus water leakage in the pipes can be prevented when the water tank is detached.

Furthermore, in order to attain the above object, a high frequency heating apparatus having a steam generating function according to claim 7 may be characterized in that in the high frequency heating apparatus having the steam generating function of claim 6, the confronting tip portions of the waterproof valves are pressed against each other in contact with each other to secure the water supply path, and separated from each other to close the water supply path by spring force.

When the tips of the two waterproof valves are pressed against each other, the valve plugs thereof are mutually displaced and the water supply path can be secured. When the pressing force is released, the valve plugs are elastically restored by the spring force to close the water supply path.

Figure 1:
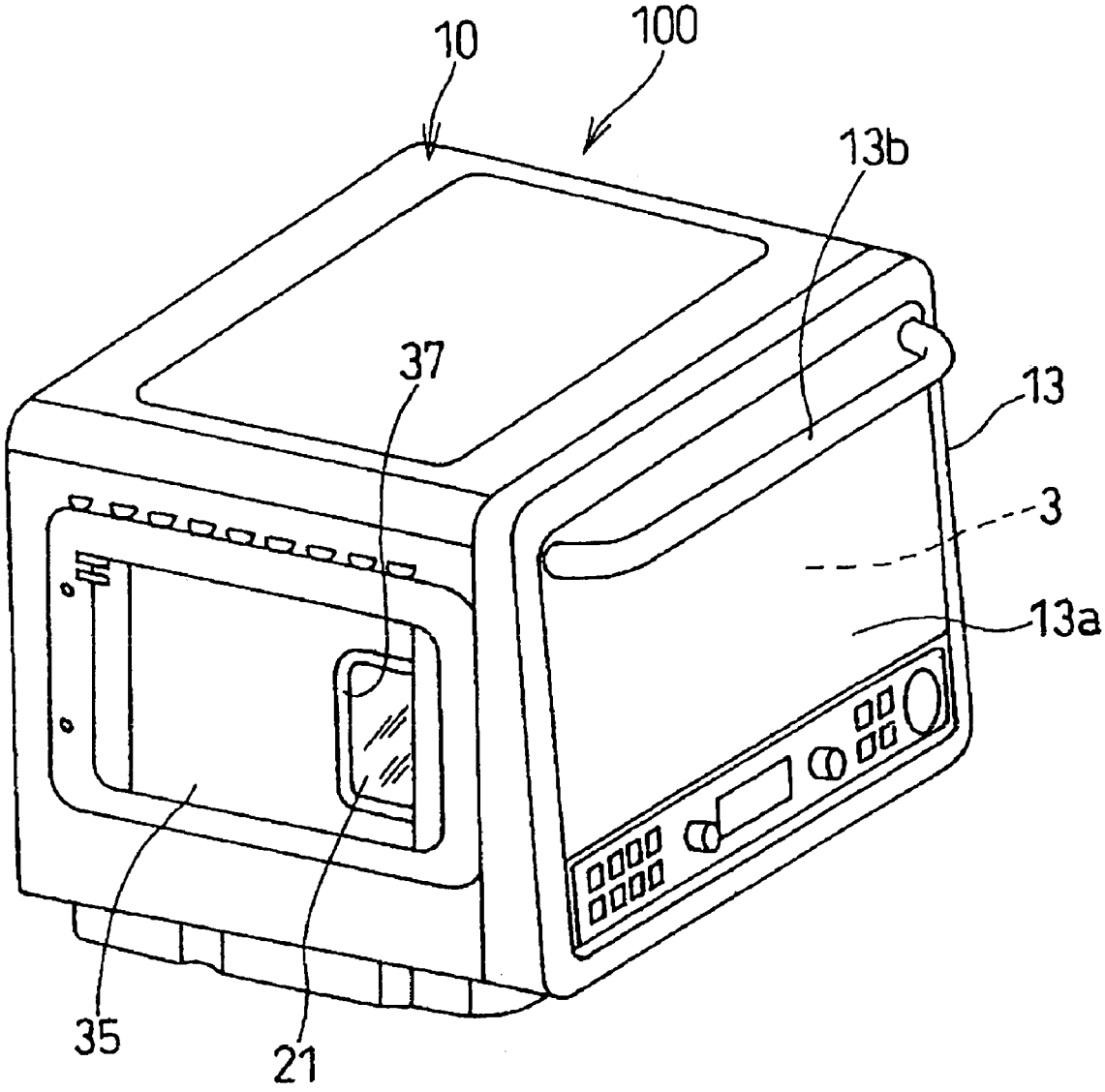
FIG. 1 is a perspective view showing the outlook of an embodiment of a high frequency heating apparatus having a steam generating function according to the present invention.

Reference Numerals in the figures; 3 represents heating chamber, 4 represents bottom plate, 5 represents high frequency wave generating means, 7 represents steam supply mechanism, 13 represents opening/closing door, 15 represents partition wall, 17 represents stirrer vane, 21 represents water tank, 22 represents main body of container, 22*b* represents joint port, 23 represents opening/closing lid, 25 represents water supply tray, 27 represents heating means, 27*a* represents assembly block, 29 represents water supply path, 29*a* represents base end pipe portion, 29*b* represents horizontal pipe portion, 29*c* represents vertical pipe portion, 29*d* represents upper pipe portion, 33 represents waterproof valve at tank side, 35 represents tank accommodating portion, 36 represents tank insertion port, 41 represents thermistor (temperature detecting sensor), 45 represents waterproof valve at pipe side and 47 represents check valve.

BEST MODES FOR CARRYING OUT THE INVENTION

A high frequency heating apparatus having a steam generating function according to an embodiment of the present invention will be described hereunder in detail with reference to the accompanying drawings.

Figure 2:
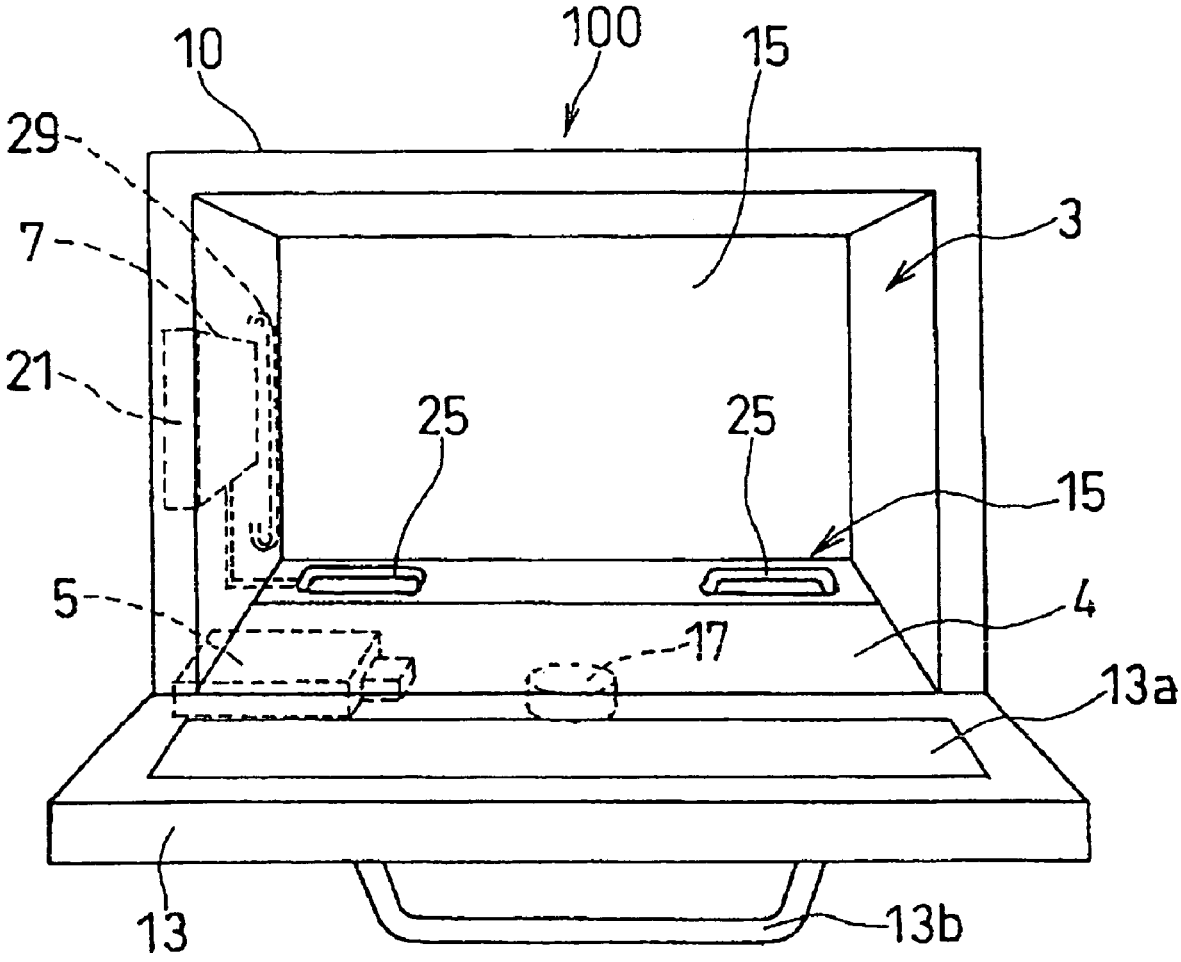
FIG. 2 is a diagram showing the construction of the high frequency heating apparatus having the steam generating function shown in FIG. 1 when the inside of a heating chamber is viewed from the front side while the opening/closing door of the heating chamber is opened.

FIGS. 1 and 2 are diagrams showing the outlook of an embodiment of a high frequency heating apparatus having a steam generating function according to the present invention.

The high frequency heating apparatus 100 having the steam generating function according to the embodiment of the present invention is used as an electronic oven that can carry out heating with high frequency heating and heating steam for cooking of foodstuff. The high frequency heating apparatus 100 is equipped with high frequency wave generating means (magnetron) 5 for outputting a high frequency wave into a heating chamber 3 in which heat target such as foodstuff or the like is accommodated, and a steam supply mechanism 7 for supplying heating steam into the heating chamber 3, and supplies at least one of the high frequency wave and the heating steam into the heating chamber 3 to cook the heat target in the heating chamber 3.

The heating chamber 3 is formed in a main body case 10 having a box shape which is opened at the front side thereof, and an opening/closing door 13 having a light transmissible window 13*a* which opens/closes a heat target take-out port of the heating chamber 3 is provided at the front side of the main body case 10. The lower end of the opening/closing door 13 is joined through a hinge to the lower edge of the main body case 10, so that the opening/closing door 13 can be opened/closed in the up-and-down direction. By grasping a knob 13*b* provided at the upper portion of the opening/closing door 13 and pulling it forwardly, it is set to an open state shown in FIG. 2.

A predetermined heat insulation space is secured between the wall surfaces of the heating chamber 3 and the main body case 10, and a heat insulating material is filled in the space as occasion demands.

Particularly, the space at the back side of the heating chamber 3 is used as a circulating fan chamber in which a circulating fan for stirring the atmosphere in the heating chamber 3 and a driving motor (not shown) for driving the circulating fan are accommodated, and the wall of the back side of the heating chamber 3 is used as a partition wall through which the heating chamber 3 and the circulating fan chamber are partitioned from each other.

As not shown, an air sucking vent hole for sucking air from the heating chamber 3 side to the circulating fan chamber side, and an air blowing vent hole for blowing air from the circulating fan chamber side to the heating chamber 3 side are provided in the partition wall 15 corresponding to the back side wall of the heating chamber 3 so that the formation areas thereof are discriminated from each other. Each vent hole is formed so as to have many punch holes.

In the case of this embodiment, as shown in FIG. 2, the high frequency wave generating means (magnetron) 5 is disposed in a space at the lower side of the heating chamber 3, and a stirrer vane 17 is provided at such a position as to receive a high frequency wave occurring from the high frequency heating apparatus 5. The high frequency wave from the high frequency wave generating means 5 is irradiated to the rotating stirrer vane 17, whereby the high frequency wave is supplied to the heating chamber 3 while stirred by the stirrer vane 17. The disposing position of the high frequency wave generating means 5 and the stirrer vane 17 is not limited to the bottom portion of the heating chamber 3, but they may be disposed at the upper surface or side surface of the heating chamber 3.

Figure 3:
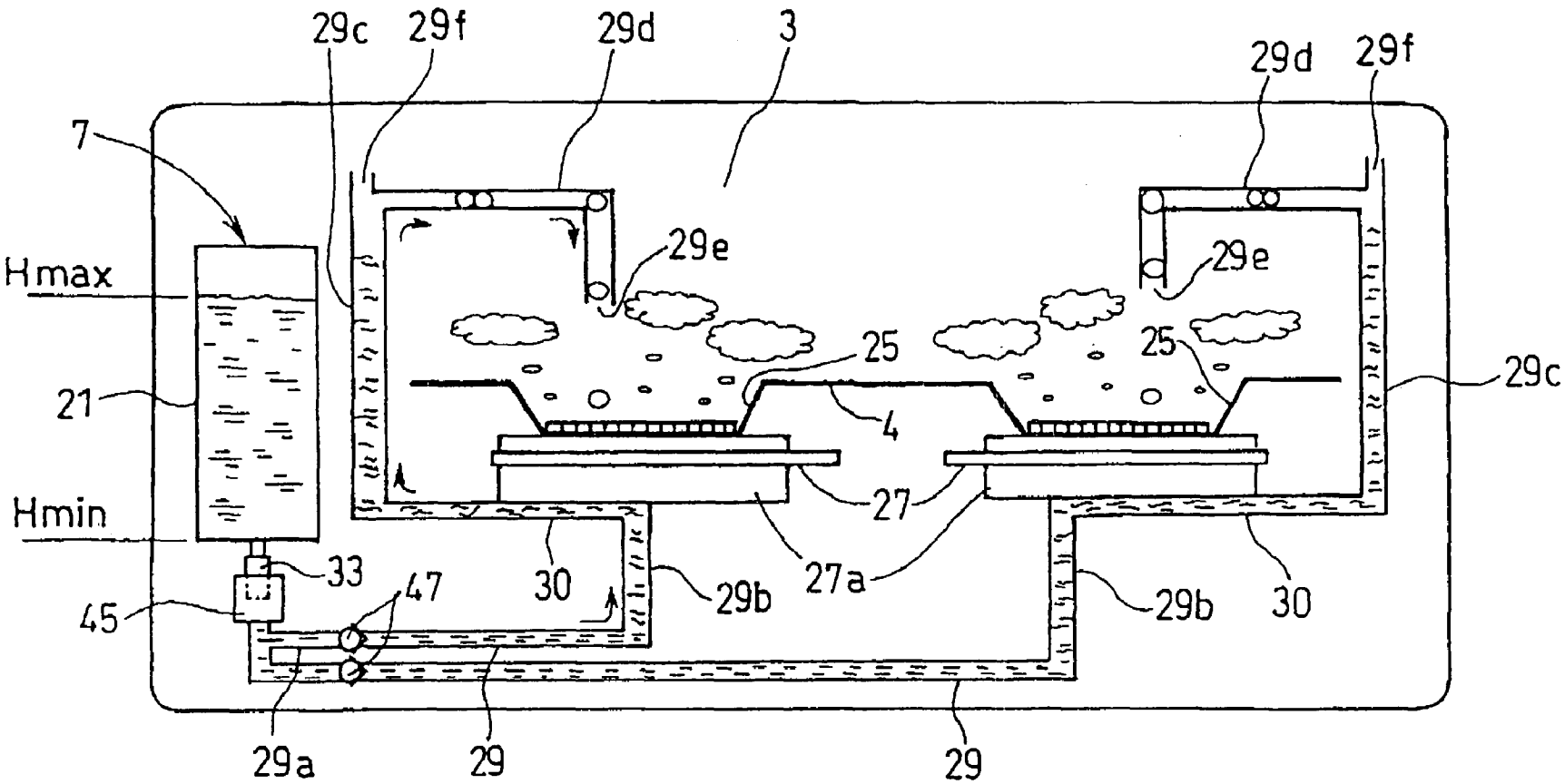
FIG. 3 is a diagram showing the construction of a steam supply mechanism of the high frequency heating apparatus having the steam generating function shown in FIG. 1.

As shown in FIG. 3, the steam supply mechanism 7 comprises a water tank 21 detachably mounted in the main body of the apparatus, two water supply trays 25, 25 equipped in the heating chamber 3, heating means 27, 27 for heating the water supply trays 25, 25 to vaporize water on the water supply trays 25, 25, water supply paths 29, 29 of two systems for leading water in the water tank 21 to the water supply trays 25, 25 through heating areas based on the heating means 27, 27, a waterproof valve 33 at the tank side and a waterproof valve 45 at the water supply path side each of which is provided at the connection portion between the water tank 21 and each of the water supply paths 29, 29 to prevent water leakage in the water tank and the water supply path when the water tank 21 is detached, and check valves 47, 47 which are disposed at the downstream side of the waterproof valve 45 at the water supply path side and prevents backflow of water from the water supply path 29 to the water tank 21.

The construction of the water supply paths 29, 29 comprising the two systems is characterized in that the distances from the heating areas based on the respective heating means 27, 27 to the water blow-out ports 29*e*, 29*e* at the tips of the water supply paths are set to be equal to each other.

Figure 4:
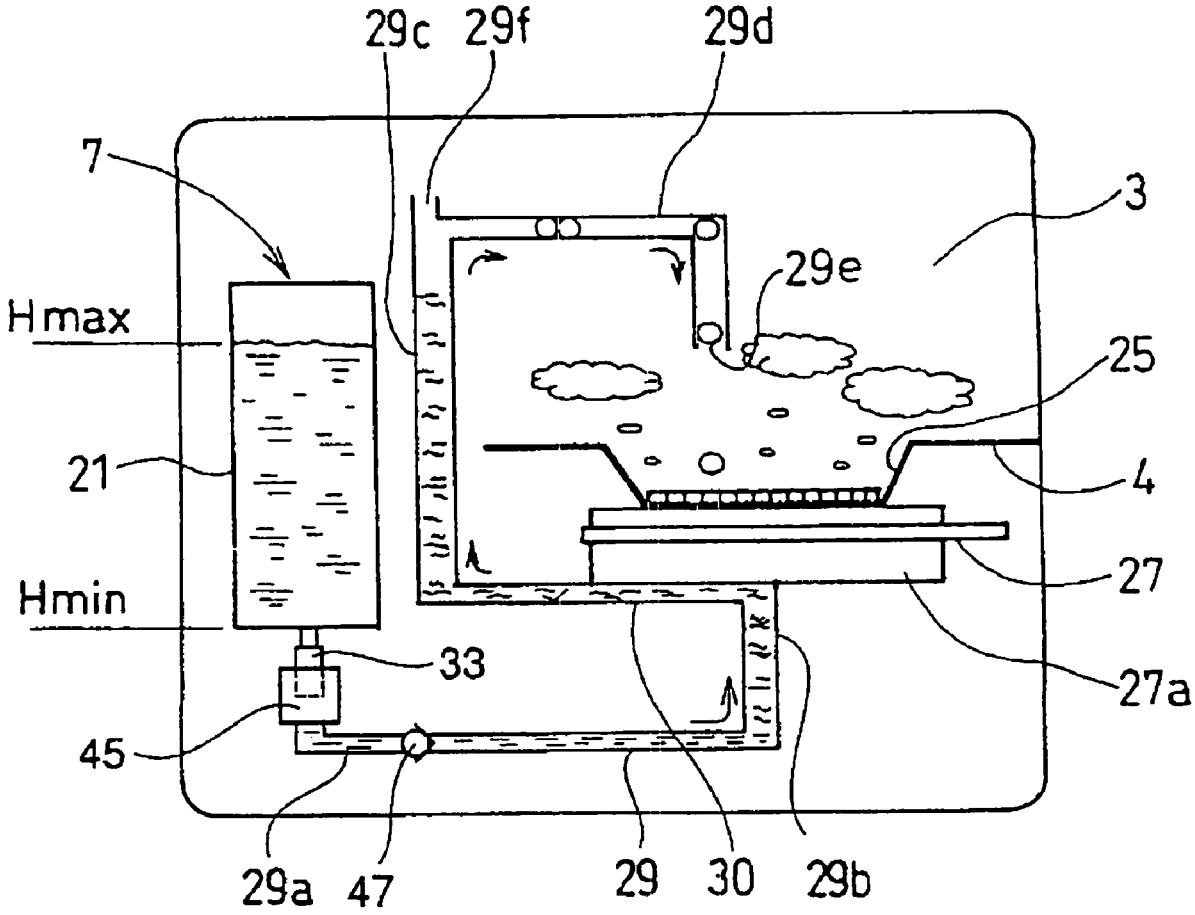
FIG. 4 is a diagram showing the construction of the steam supply mechanism when one water supply tray is provided.

The steam supply mechanism 7 may be designed so that water is supplied from the water supply system 29 of one system to one water supply tray to generate steam as shown in FIG. 4.

In this embodiment, the water tank 21 is designed as a cartridge type having a planular rectangular parallelepiped shape which is excellent in handling. It can be easily detachably mounted in the main body of the apparatus (main body case 10), and also the water tank 21 is inserted and mounted in a tank accommodation portion 35 installed on the side surface of the main body case 10 as shown in FIG. 1 so that it is hardly thermally damaged by heating in the heating chamber 3.

Figure 5:
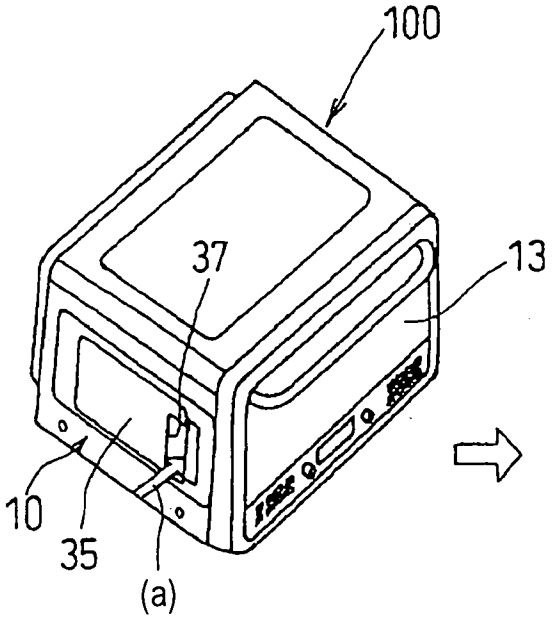
FIG. 5 is a diagram showing a detaching operation of a water tank in the high frequency heating apparatus having the steam generating function shown in FIG. 1, wherein (a) shows a mount state of the water tank, (b) shows an exposure state of a tank insertion port, and (c) shows a removing state of the water tank.
Figure 5:
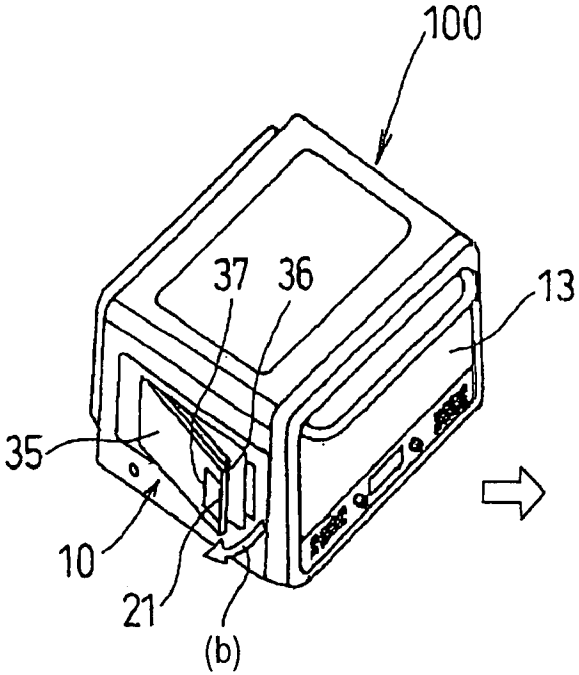
Figure 5:
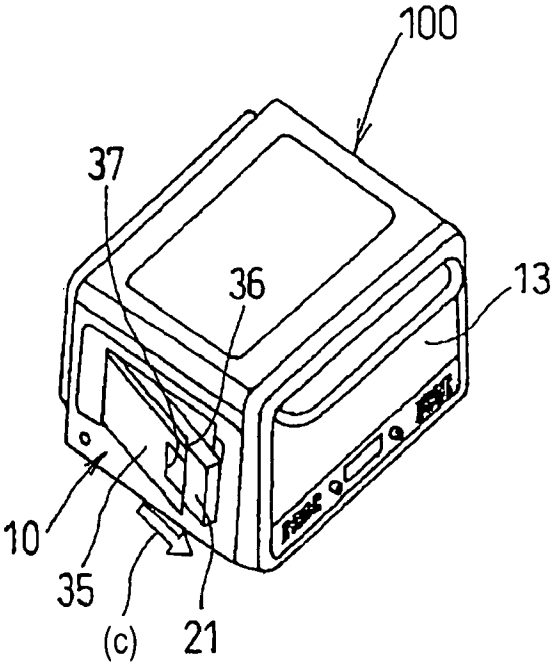

As shown in FIG. 5, the rear end side of the tank accommodation portion 35 is joined to the main body case 10 through a hinge, and when the engagement at the front end portion is released as indicated by an arrow (a) in FIG. 5(*a*), the front end side is outwardly swung and the tank insertion port 36 at the front end is exposed as indicated by an arrow (b) in FIG. 5(*b*).

Under the state that the tank insertion port 36 is exposed, the water tank 21 can be unloaded in a direction indicated by an arrow (c) in FIG. 5(*c*).

The loading of the water tank 21 is completed by inserting the water tank 21 into the tank insertion port 36 in the opposite direction to the unloading direction.

Figure 6:
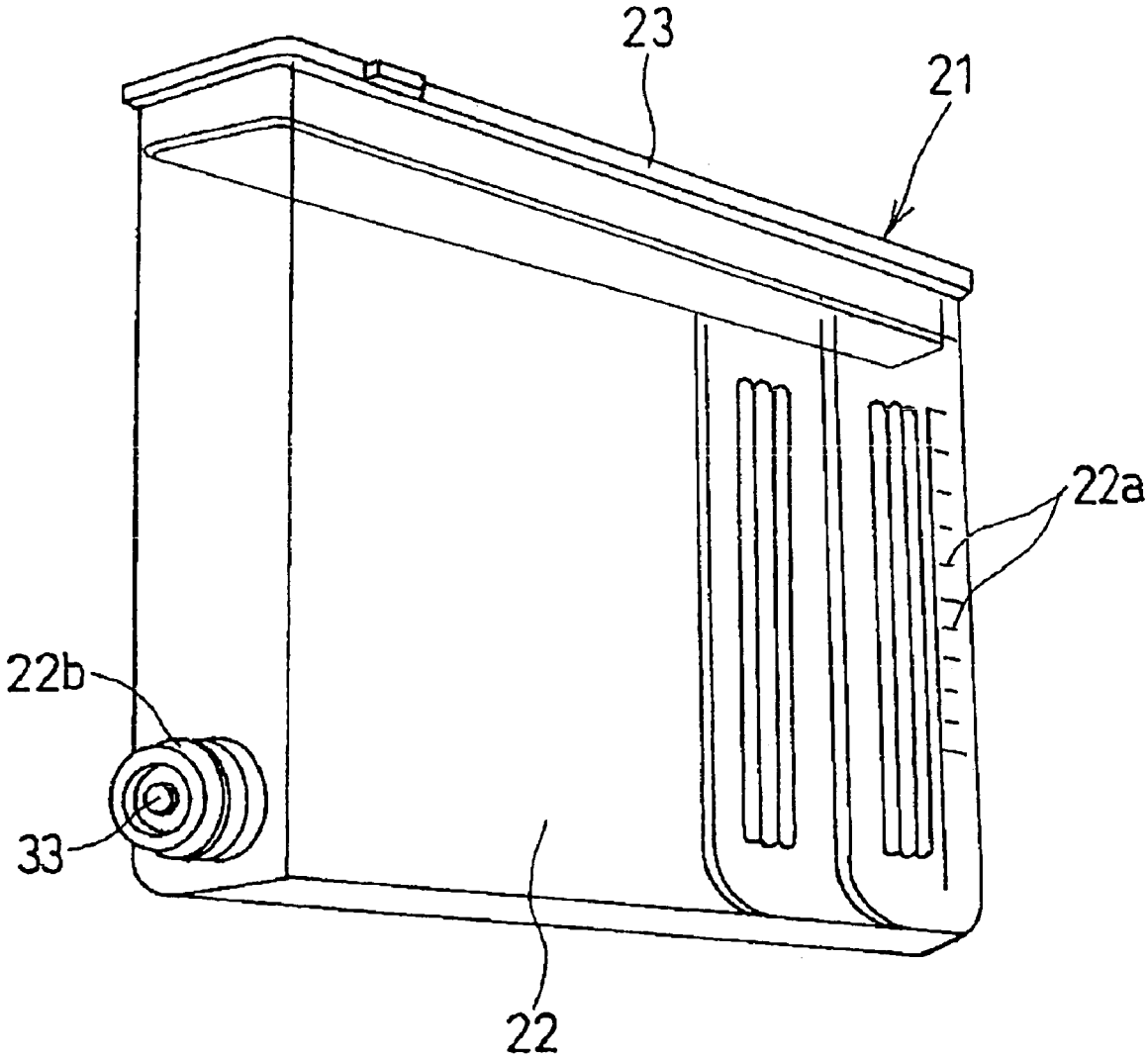
FIG. 6 is an enlarged perspective view of the water tank used in the steam supply mechanism shown in FIG. 4.

As shown in FIG. 6, the water tank 21 comprises a container body 22 having a planular rectangular parallelepiped shape opened at the upper portion thereof, and an opening/closing lid 23 for covering the opening portion at the upper portion of the container body 22. The container body 22 and the opening/closing lid 23 are formed of resin.

Figure 7:
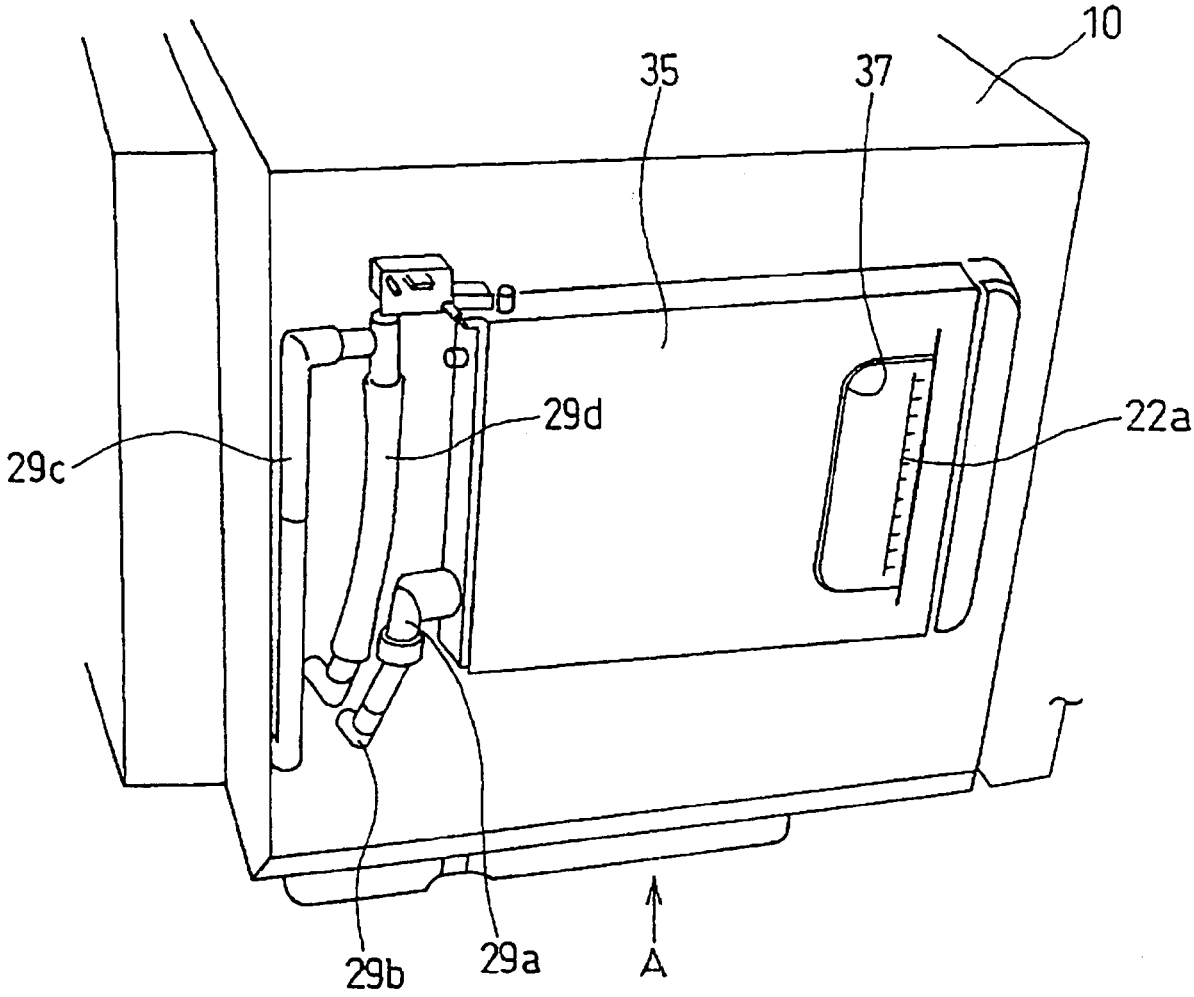
FIG. 7 is a diagram showing a fixing structure of the steam supply mechanism of FIG. 4 on the side surface of the apparatus.

The container body 22 is formed of transparent resin so that the residual amount of water in the container body 22 can be visually recognized, and scales 22*a* indicating the residual water level are provided on both the side surfaces of the container body 22. As shown in FIGS. 5 and 7, the sites at which the scales 22*a* are provided are exposed to the outside through cut-out windows 37 formed at the front side edges of the tank accommodation portion 35 so that the residual amount of water in the water tank 21 can be visually recognized from the outside.

Figure 8:
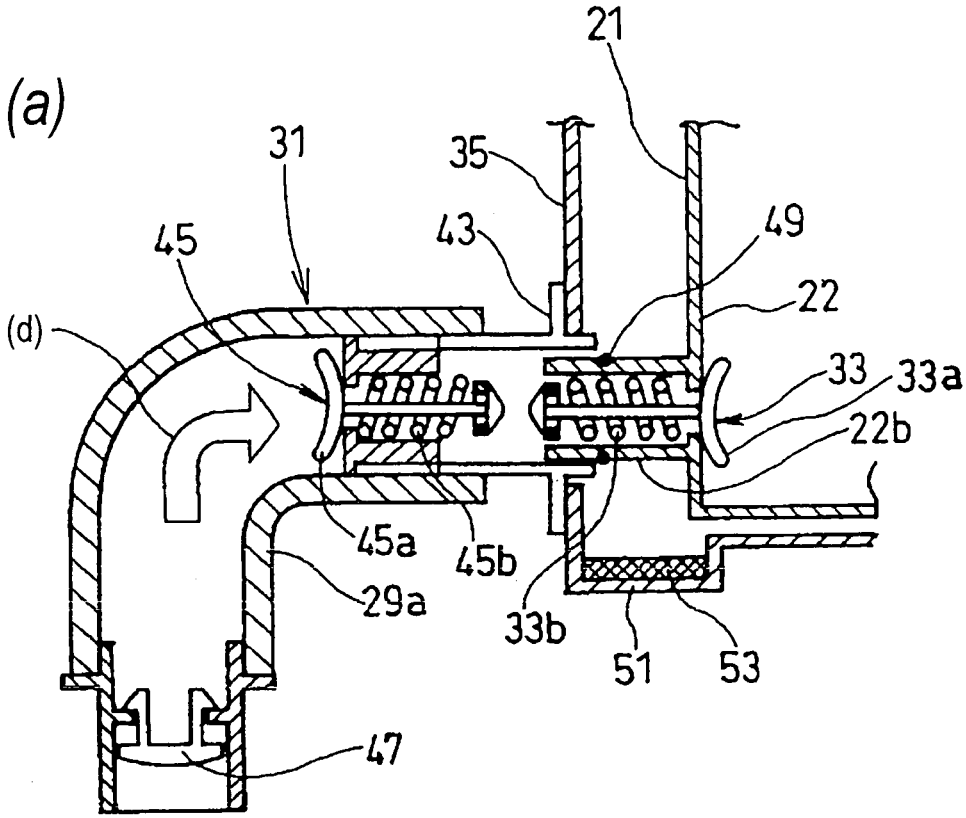
FIG. 8 is a diagram showing a backflow preventing structure at the joint portion between the water tank shown in FIG. 6 and the base end portion of the water supply path.
Figure 8:
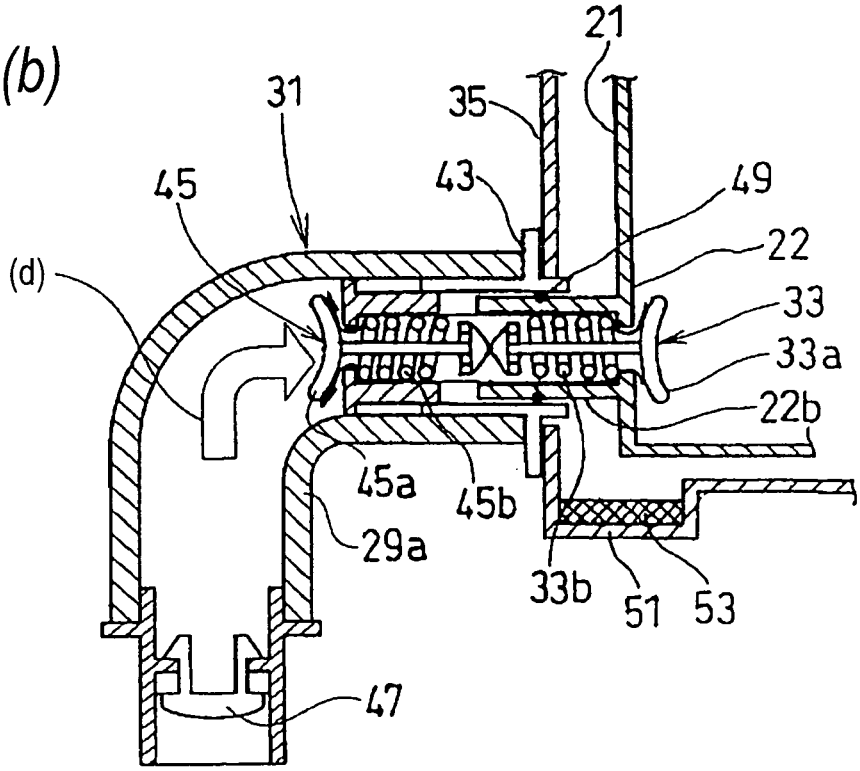

As shown in FIG. 6, a cylindrical connection port 22*b* which is engagedly connected to the water supply path 29 is provided at a position near to the lower portion on the back surface of the container body 22 so as to project from the container body 22. As shown in FIG. 8(*a*), the connection port 22*b* is provided with a waterproof valve 33 at the tank side which closes the connection port 22*b* and prevents flow-out of the stocked water under the state that the water tank 21 is taken out from the main body of the apparatus.

The water supply tray 25 of this embodiment is formed by forming a water-receiving recess at a part of the bottom plate 4 of the heating chamber 3, and it is formed integrally with the bottom plate 4.

As described above, the water supply trays 25 are provided at the right and left sides of the rear portion of the bottom plate 4 in this embodiment.

Figure 9:
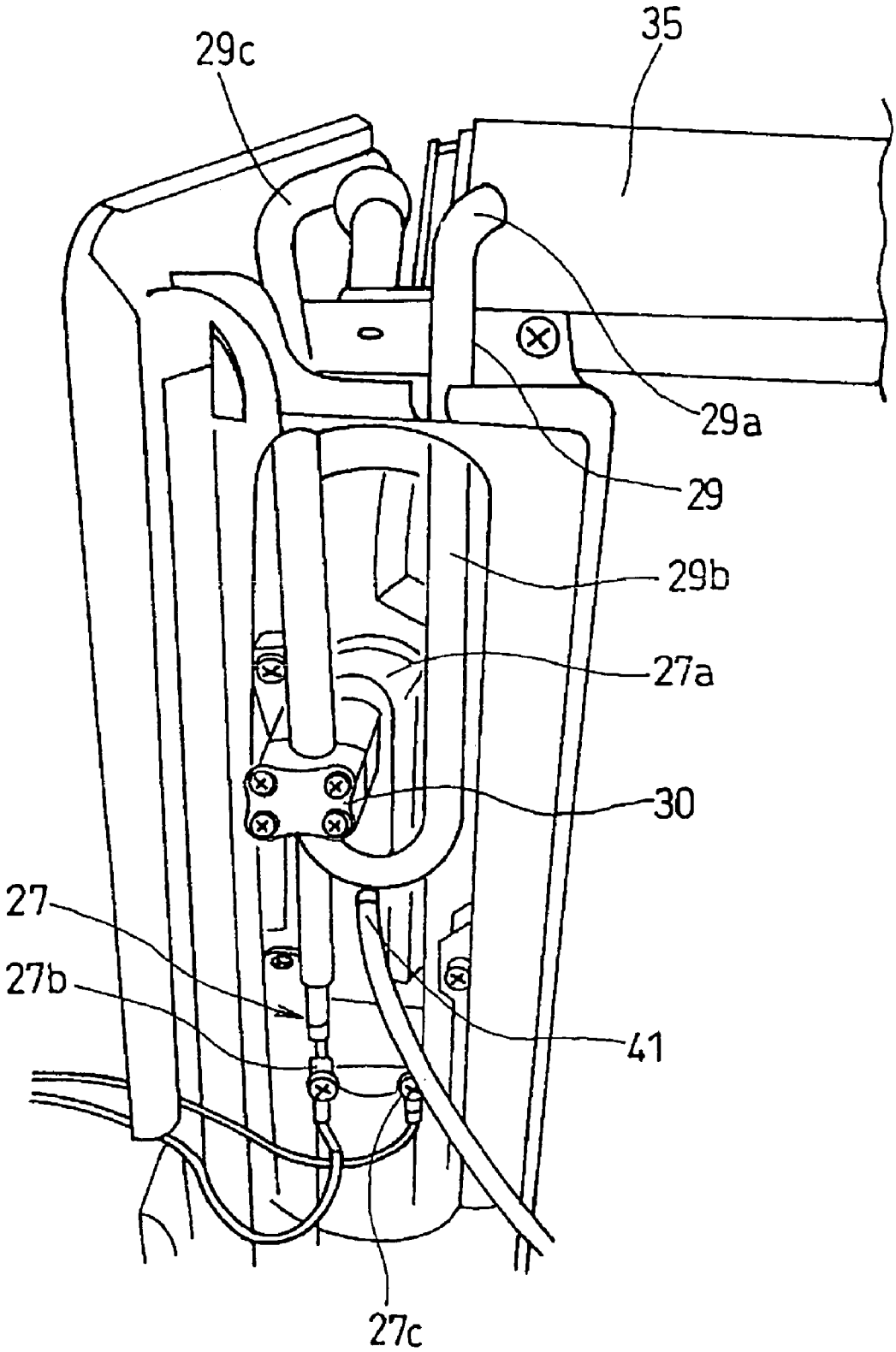
FIG. 9 is a view taken along an arrow of A, and shows the construction that the water supply path is heated by heating means disposed at the bottom portion of the apparatus.

The heating means 27 is a sheathed heater disposed in contact with the lower surface of each water supply tray 25, and it is designed so that a heater body is installed in an assembly block 27*a* formed of aluminum die cast which is brought into close contact with the back surface of the water supply tray 25 as shown in FIG. 9. In this embodiment, a thermistor 41 as a temperature detecting sensor for detecting the temperature of the hating means 27 is connected between a pair of electrodes 27*b* and 27*c* at both the ends of the heater extending from the assembly block 27*a*.

The thermistor 41 is provided between the pair of electrodes 27*b* and 27*c* while embedded in the assembly block 27*a*. The detection signal of the thermistor 41 is monitored by a control circuit (not shown), and it is used for the residual amount 0 detection of the water tank 21 and the operation control of the heating means 27 (the control of the quantity of heat).

Figure 10:
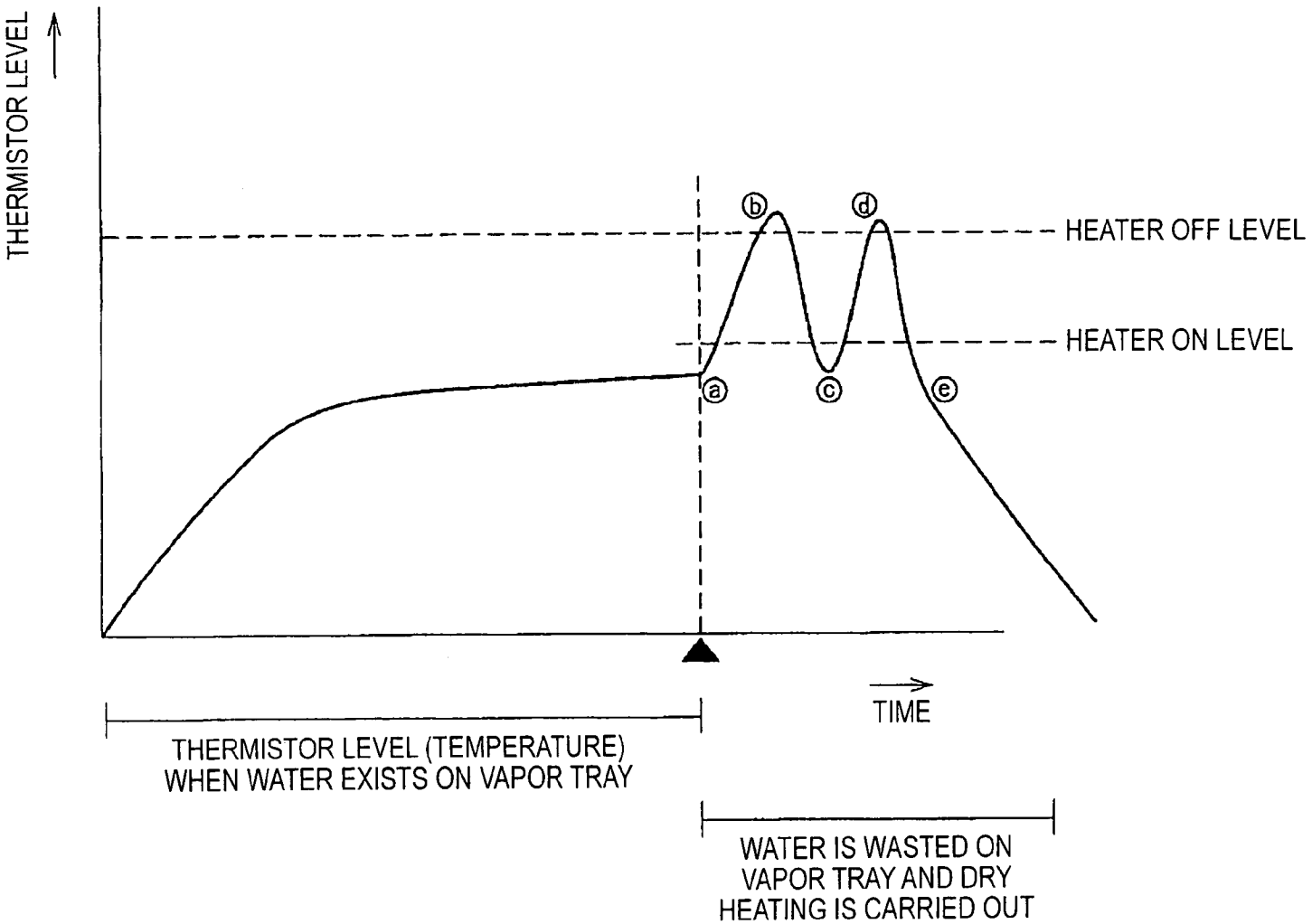
FIG. 10 is a diagram showing steam amount control and abnormality detection by a thermistor.

As shown in FIG. 10, when water is supplied from the water tank 21 and filled on the water supply tray 25, the detection temperature level of the thermistor 41 increases in connection with the temperature increase of the heating means 21. However, when water is wasted on the water supply tray 25 as indicated by a symbol a in FIG. 10, the detection temperature level is rapidly increased because the current supply to the heating means 21 is carried out, and thus the thermistor level exceeds an upper limit reference value indicated by b.

The control circuit (not shown in the figures) interrupts current supply to the heating means 21 at the time point when the thermistor level exceeds the upper limit reference value. At this time point, the detection temperature level of the thermistor 41 decreases although there is some overshoot. Finally, at the time point when the detection temperature level of the thermistor 41 reaches the lower limit reference value indicated by c, the control circuit carries out current supply to the heating means 21 again to heat the heater. However, since there is no water on the water supply tray 25, the detection temperature level of the thermistor 41 increases again, and exceeds the upper limit reference value indicated by d. At this time point, the control circuit judges that no water exists on the water supply tray 25 and the heating means 21 is under a dry heating state, and it interrupts current supply to the heating means 21 as indicated by e and emits an alarm to stop the steam heating treatment.

In this embodiment, as described above, the generation control of the steam amount and the detection of abnormality occurring when water is wasted on the water supply tray can be detected by a single thermistor.

Furthermore, the above control can enables increase of the lifetime of the heater and the use of the water supply tray within the heat-resistance temperature, whereby the fluorine resin coated surface of the water supply tray can be prevented from being deteriorated.

In this embodiment, when the cycle of turning on and off the heater is repeated and the thermistor detects the temperature corresponding to the upper limit reference value twice, it is judged that there is no water on the water supply tray. However, the detection frequency is not limited to twice, and it may be judged by detecting the temperature concerned at plural times.

Furthermore, in this embodiment, the sheathed heater is used as the heating means 27, however, a glass tube heater, a plate heater or the like may be used in place of the sheathed heater.

As shown in FIGS. 3 and 9, each water supply path 29 comprises a base end pipe portion 29*a* which is connected to the connection port 22*b* of the water tank 21 while branched to the two systems, a horizontal pipe portion 29*b* laid below the bottom plate 4 of the heating chamber 3 so as to pass from the base end pipe portion 29*a* through the heating areas based on the respective heating means 27, a vertical pipe portion 29*c* erecting vertically from the tip of the horizontal pipe portion 29*b* along the side of the heating chamber 3, an upper pipe portion 29*d* that extends upwardly from the upper end of the vertical pipe portion 29*c* to the upper side of the water supply tray 25 and drops water fed from the vertical pipe portion 29*c* under pressure to the water supply tray 25, and a water blow-out port 29*e* forming the tip of the upper pipe portion 29*d*.

As shown in FIG. 3, the horizontal pipe portion 29*b* is laid so as to come into contact with the assembly block 27 of the heating means 27, and the contact portion 30 thereof with the assembly block 27*a* shown in FIG. 9 served as the heating area based on the heating means 27.

Accordingly, the characterizing portion of the two systems in the steam supply mechanism 7 described above resides in that the length of the pipe path from each contact portion 0 to each water blow-out port 29*e* is set to be equal between the two systems.

In this embodiment, the horizontal pipe portion 29*b* of each water supply path 29 is set as the heating area based on the heating means 27, and water which is thermally expanded through the thermal conduction of heat generated by each heating means 27 is supplied to each water supply tray 25.

The situation that steam occurs will be described in detail. When the heating means 27, 27 is heated under the state that the water tank 21 is inserted in the tank accommodation portion 35 and water is filled in the horizontal pipe portions 29*b*, 29*b*, water in the pipes is heated at the contact portions 30, 30 with the assembly blocks 27*a*, 27*a* and thermally expanded. The check valves 47, 47 temporarily stop the pressure of the expanding water in the pipes, and thus the pressure of the water directs in only the direction to the vertical pipe portions 29*c*, 29*c*. Then, the expanded water passes through the upper pipe portions 29*d*, 29*d*, and drops from the respective water blow-out ports 29*e*, 29*e* to the water supply trays 25, 25.

At this time, the distances from the contact portions 30, 30 of the assembly blocks 27*a*, 27*a* to the water blow-out ports 29*e*, 29*e* are set to be equal to each other. Therefore, the same quantity of heat can be applied from the contact portions 30, 30 by applying the heating means 27, 27 designed based on the same specification, whereby water can be uniformly supplied to the respective water supply trays 25, 25.

Furthermore, if the distances from the contact portions 30 to the respective water blow-out ports 29*e*, 29*e* are set to be equal to each other, the water supply paths 29, 29 and the contact portions 30, 30 can be set to be equal to each other in temperature, and thus the steam generation control can be easily performed.

The water supplied to each of the water supply trays 25, 25 is kept to be increased in temperature with the heat generated by each of the heating means 27, 27. Therefore, the time required from the supply of the water to the water supply trays 25, 25 till the time when steam occurs can be shortened and thus rapid steam heating can be performed.

If heating is interrupted, the water in the vertical pipe portions 29*c*, 29*c* of the water supply paths 29, 29 would stop its expansion and thus the water does not reach air intake ports 29*f*, 29*f*, so that the ambient pressure enters from the air intake ports 29*f*, 29*f* into the pipes and thus the water supply is stopped.

As shown in FIG. 8(*a*), with respect to the base end pipe portion 29*a*, a waterproof valve 45 at the pipe side for preventing water leakage from the horizontal pipe portion 29*b* side when the water tank 22 is removed is equipped to a base end circular pipe portion 43 in which the connection port 22*b* of he container body 22 is engagedly fitted, and a check valve 47 for preventing backflow from the horizontal pipe portion 29*b* side (the flow in the direction of an arrow (d) in FIG. 8(*a*)) due to thermal expansion of water in the horizontal pipe portion 29*b* is equipped to the connection portion with the horizontal pipe portion 29*b*.

With respect to the waterproof valve 45 at the tank side and the waterproof valve 45 at the pipe side, springs 33*b* and 45*b* for urging the valve plugs 33*a*, 45*a* are set to be opposite to each other in urging direction. When the connection port 22*b* of the container body 22 is properly engagedly fitted to the base end circular pipe portion 43, the tip portions of both the valve plugs 33*a*, 45*a* abut against each other as shown in FIG. 8(*b*), so that one valve plug displaces the other valve plug against the urging force of the spring 33*b*, 45*b* to set the flow path to an open state.

An O ring 49 as a seal member for closing the gap between the connection port 22*b* of the container body 22 and the base end circular pipe portion 43 is provided on the outer peripheral portion of the connection port 22*b* of the container body 22.

The state shown in FIG. 8(*a*) is a state that the connection port 22 of the container body 22 has not yet been engagedly fitted to the base end circular pipe portion 43 and both the waterproof valve 33 at the tank side and the waterproof valve 45 at the pipe side are set to close the flow path.

Under the state that the connection port 22*b* of the container body 22 is detached from the base end circular pipe portion 43, the water supply path 29 side is sealed by the waterproof valve 45 at the pipe side and thus the backflow of water in the water supply path 29 can be surely prevented. That is, as shown in FIG. 3, when the water tank 21 is inserted in the tank accommodation portion 35, water flows into the vertical pipe portion 29*c* of each water supply path 29 at the same water level as the water tank 21. The water backflow can be prevented by the waterproof valve 45 at the pipe side even when the water tank 21 is removed under the water pressure as described above.

The bottom portion of the back side of the tank accommodation portion 35 is provided with a recess portion 51 for receiving a small amount of water remaining between the waterproof valve 33 at the tank side and the waterproof valve at the pipe side and dropping therefrom when the water tank 21 is removed from the tank accommodation portion 35, and a water absorption sheet 53 for absorbing water thus dropping is provided to the recess portion 51. Non-woven fabric having an excellent water absorbing property or the like is used as the water absorption sheet 53, for example.

As shown in FIGS. 3 and 4, the upper end of the vertical pipe portion to which the upper pipe portion 29*d* is connected is set to be located at a higher position than the maximum level position $H_{max}$ of the water stocked in the water tank 21. This is to prevent the water stocked in the water tank 21 from carelessly and continuously flowing out to the upper pipe portion 29*d* side by a communicating tube action.

Furthermore, the water supply path 29 is connected through the base pipe portion 29*a* to the water tank 21 at a position lower than the minimum level Hmin of the water stocked in the water tank 21.

This is to enable the water stocked in the water tank 21 to be completely taken into the water supply path 29 side.

In the case of this embodiment, the water supply trays 25 and the heating means 27 are equipped at the right and left sides of the rear portion of the bottom plate 4 of the heating chamber 3. Therefore, as shown in FIG. 4, the water supply paths 29, 29 of the two systems are branched through the check valves 47, 47 to the two horizontal pipe portions 29*b*, 29*b* at the downstream side of the base end pipe portions 29*a*, 29*a*, and the horizontal pipe portions 29*b*, 29*b*, the vertical pipe portions 29*c*, 29*c*, the upper pipe portions 29*d*, 29*d* and the contact portions 30, 30 for supplying the heat of the heater to the water in the pipes in contact with the assembly blocks 27*a* are laid to the heating means 27, 27. The water supply paths 29 provided to the respective water supply trays 25, 25 are designed so that the distance from the contact portion 30, 30 to the water blow-out port 29*e*, 29*e* at the tip of the pipe is equal between both the water supply paths 29.

In the high frequency heating apparatus 100 having the steam generating function described above, the water supply paths 29 are laid so as to pass through the heating areas based on the heating means 27 to thereby achieve a pumping function by the thermal expansion of water in the water supply paths 29 which is caused by the heat occurring in the heating means 27. Therefore, it is unnecessary to provide dedicated pump means for supplying water in the water tank 21 to the water supply trays 25.

Accordingly, the simplification and miniaturization of the construction of the steam supply mechanism 7 can be implemented by omitting the dedicated pump means.

Furthermore, the water supply to the water supply trays 25 is carried out with the heat generated by the heating means 27. Therefore, the control of the steam supply amount can be implemented by only the control of the heating operation of the heating means 27, and thus the control processing needed for the steam supply amount control can be more greatly simplified as compared with the prior art in which the dedicated pump means must be controlled.

Furthermore, the water supplied to the water supply trays 25 is under the state that the temperature of the water is increased by the heat occurring in the heating means 27, and thus the time required until steam is generated from the supply of the water to the water supply trays 25 can be shortened, and the steam heating can be rapidly performed.

Furthermore, in the above construction, when the residual amount of the water tank 21 is equal to 0 (zero) and thus the residual water amount on the water supply trays 25 is reduced, the quantity of heat consumed by vaporization of water is reduced. Therefore, the temperature of the heating means 27 and the water supply trays 25 is increased.

However, since the steam supply mechanism 7 of this embodiment is equipped with the thermistor 41 for detecting the heating means 27, and thus it can be possible to detect the residual amount 0 of the water tank 21 relatively simply by monitoring the detection signal of the thermistor 41, so that occurrence of inconvenience such as dry heating or the like.

Furthermore, by using the detection signal of the thermistor, various control operations such as the operation of stopping the heating means 27, making an alarm for water supply, etc. can be performed when the residual amount 0 of the water tank 21 is detected, and the handling performance of the high frequency heating apparatus 100 can be enhanced.

In this embodiment, the thermistor 41 is brought into direct contact with the heating means 27, however, it may be brought into contact with the water supply tray 25.

Furthermore, from the viewpoint of preventing occurrence unevenness of heating based on the heating steam in the heating chamber of the high frequency heating apparatus having the steam generating function, it is desirable that the steam generators each comprising the water supply tray 25 and the heating means 27 are dispersively equipped at plural places in the heating chamber 3 to make the heating steam supply itself uniform in the heating chamber 3. However, some device for uniformly supplying water to the water supply trays 25 at plural places is needed when the steam generators are dispersively equipped at plural places.

In the case where plural pairs of water supply trays 25 and heating means 27 are equipped as described above, if the distance from the contact portion with the heater to the water blow-out port at the tip of the pipe is set to be equal among the water supply paths 29 of the respective water supply trays 25, the water supply amount can be made coincident among the water supply paths 29, so that the uniform supply of heating steam in the heating chamber 3 can be implemented in low cost without particularly controlling the supply water amount.

The present invention has been described in detail by referring to the specific embodiments, however, it is obvious to persons skilled in the art that various alterations and modifications may be made without departing the spirit and subject of the present invention.

The present application is based on Japanese Patent Application No. 2003-067065 filed on Mar. 12, 2003, and the content thereof is taken in this specification.

INDUSTRIAL APPLICABILITY

The high frequency heating apparatus having the steam generating function has the pumping function by the thermal expansion of the water in the water supply path due to the heat generated by the heating means, and thus no dedicated pump means is necessary. Therefore, the construction of the steam supply mechanism can be simplified and miniaturized.

Furthermore, the supply amount control of steam can be achieved by merely controlling the heating operation of the heating means, and thus the control processing can be simplified.

Still furthermore, when the residual amount of the water tank is equal to 0 (zero) and thus the residual water amount on the water supply tray is reduced, so that the heating means or the water supply tray is increased in temperature. However, if the temperature sensor for detecting the temperature of the heating means or the water supply tray is provided, the residual amount zero of the water tank can be relatively simply detected by monitoring the detection signal of the temperature sensor.

Furthermore, when steam generators each comprising a water supply tray and heating means are dispersively equipped at plural places in the heating chamber, the uniform supply of heating steam in the heating chamber can be implemented in low cost.

The invention claimed is:

1. A high frequency heating apparatus having a steam generating function, comprising:

a heating chamber in which a heating target to be heated is accommodated;

high frequency wave generating means for outputting a high frequency wave into the heating chamber; and a steam supply mechanism for supplying heating steam into the heating chamber, wherein at least one of the high frequency wave and the heating steam is supplied into the heating chamber to carry out a heating treatment on the heating target, and the steam supply mechanism comprises:

a water tank detachably secured to the main body of the apparatus, a water supply tray, heating means located in the vicinity of the water supply tray for heating the water supply tray to vaporize water on the water supply tray, a water supply path for leading water in the water tank to the water supply tray through a heating area based on the heating means, whereby water in the water supply path which is thermally expanded through thermal conduction of heat generated by the heating means is supplied to the water supply tray, and a check valve at the base end side of the water supply path to prevent thermally expanded water from flowing back to the water tank side.

2. The high frequency heating apparatus having the steam generating function according to claim 1, wherein the steam supply mechanism is further equipped with a temperature detecting sensor for detecting the temperature of the heating means or the water supply tray, and utilizes the detection signal of the temperature detecting sensor for detecting the residual amount zero of the water tank or controlling the operation of the heating means.

3. The high frequency heating apparatus according to claim 2, wherein the heating means is formed by disposing a heater in an assembly block of aluminum die cast, and the temperature detecting sensor serves as a thermistor secured to the assembly block so that generation of the steam amount and detection of abnormality when water has been wasted can be performed by a single thermistor.

4. The high frequency heating apparatus having the steam generating function according to claim 2, wherein the steam supply mechanism is further equipped with a control circuit for judging that the residual amount of the water tank is equal to 0 and stopping steam heating when a cycle of interrupting current supply to the heater when the detection temperature of the thermistor exceeds a predetermined upper limit reference value and re-supplying current to the heater when the detection temperature of the thermistor is reduced to less than a predetermined lower limit reference value with time lapse is carried out at least twice or more.

5. The high frequency heating apparatus having the steam generating function of claim 1, wherein when a plurality of pairs of water supply trays and heating means are equipped, the distance from the heating area based on the heating means to a water blow-out port at a tip of each water supply path equipped every water supply tray is set to be equal among the water supply paths.

6. A high frequency heating apparatus having a steam generating function, comprising:

a heating chamber in which a heating target to be heated is accommodated;

high frequency wave generating means for outputting a high frequency wave into the heating chamber; and a steam supply mechanism for supplying heating steam into the heating chamber, wherein at least one of the high frequency wave and the heating steam is supplied into the heating chamber to carry out a heating treatment on the heating target, and the steam supply mechanism comprises:

a water tank detachably secured to the main body of the apparatus, a water supply tray, heating means for heating the water supply tray to vaporize water on the water supply tray, a water supply path for leading water in the water tank to the water supply tray through a heating area based on the heating means, whereby water in the water supply path which is thermally expanded through thermal conduction of heat generated by the heating means is supplied to the water supply tray, and a check valve at the base end side of the water supply path to prevent thermally expanded water from flowing back to the water tank side, wherein the steam supply mechanism is provided with a waterproof valve for preventing water leakage at each of a water tank side of a detachably-equipped water tank and a base end side of the water supply path.

7. The high frequency heating apparatus having the steam generating function of claim 6, wherein the confronting tip portions of the waterproof valves are pressed against each other in contact with each other to secure the water supply path, and separated from each other to close the water supply path by spring force.

* * * * *